United States Patent [19]

Turner et al.

[11] 4,244,625

[45] Jan. 13, 1981

[54] APPARATUS FOR CUTTING HARD EARTH FORMATIONS

[75] Inventors: Gilbert M. Turner; Clarence L. Stepp, both of Houston, Tex.

[73] Assignee: Boring & Tunneling Company of America, Inc., Houston, Tex.

[21] Appl. No.: 924,222

[22] Filed: Jul. 13, 1978

[51] Int. Cl.[3] ..... E21C 25/38

[52] U.S. Cl. ..... 299/83; 299/84

[58] Field of Search ..... 299/82–84

[56] References Cited

U.S. PATENT DOCUMENTS

| | | | |
|---|---|---|---|
| 3,787,091 | 1/1974 | Paolini et al. | 299/84 |
| 3,841,707 | 10/1974 | Kniff et al. | 299/84 |
| 3,954,301 | 5/1976 | Stepp | 299/84 X |
| 3,968,995 | 7/1976 | Arentzen | 299/83 X |

*Primary Examiner*—Ernest R. Purser

*Attorney, Agent, or Firm*—Arnold, White & Durkee

[57] ABSTRACT

The chain link conveyor assembly of an earth cutting machine is provided with means for mounting the conical cutting bits at a penetration angle on the range of 47° to 53° and a sideward angle in the range of 3° to 12°. Even bit wear is best promoted at penetration and sideward angles of 50° and 7½°, respectively.

9 Claims, 8 Drawing Figures

APPARATUS FOR CUTTING HARD EARTH FORMATIONS

BACKGROUND OF THE INVENTION

I. Field of the Invention

The invention relates to mechanisms for achieving cuts in hard earth formations such as cuts achieved for ditching operations in conjunction with pipeline installation, especially where such earth formations take the form of rock, ice, permafrost, etc. More particularly, the invention relates to the positioning of the conical cutting bits on the chain link conveyor assembly of an earth cutting apparatus to facilitate even bit wear.

II. Description of the Prior Art

Mechanisms for achieving cuts in earth formations are well known and equally well known are mechanisms for achieving cuts in hard earth formations such as those typically involved when subterranean mining operations are being conducted, such as coal mining, where sedimentary rock is removed for exposure of veins of coal or other minerals. Similar earth cutting techniques are utilized in ditching operations preparatory to the installation of pipeline in the earth's surface.

A well known and commercially successful type of apparatus for cutting hard earth formations is the earth cutting machine described in U.S. Pat. No. 3,954,301 to Clarence L. Stepp of Houston, Tex. This patented machine includes a chain link conveyor assembly which is articulated from a prime mover vehicle. The outwardly facing portion of the chain links include a plurality of pointed conical bits, typically having tungsten carbide tips, which are staggered for cutting along differing cutting paths along the width of the conveyor. At least one bit is positioned on each side of the conveyor for cutting the gauge of the kerf. During earth cutting operations the depth of the cut or kerf is controlled by the angulation of the conveyor mechanism relative to the prime mover.

A severe problem associated with prior cutting operations utilizing the described apparatus is the uneven and rapid wearing of the conical bits. It has been found that the tip portion of some bits wear down exceptionally fast. Other bits have been found to wear along one side very rapidly until they are no longer usable. Other kinds of uneven and rapid wear conditions have been experienced.

SUMMARY OF THE INVENTION

In accordance with the present invention, the chain link conveyor assembly of an earth cutting machine is provided with means for mounting the conical bits at a pentration angle on the range of 47° to 53° and a sideward angle in the range of 3° to 12°. Even bit wear is best promoted at penetration and sideward angles of 50° and 7½°, respectively.

In one aspect, the invention may be viewed as an improvement in the chain link conveyor assembly of an earth cutting machine wherein at least a substantial number substantially all of the cutting bits are secured to the chain link conveyor assembly at the above-described angles.

In another aspect, the invention is defined as a chain link conveyor assembly comprising a plurality of interconnected links adapted for mating engaging relation with rotary conveyor sprockets, a plurality of conical bits mounted by appropriate retainer means for rotation about their longitudinal axes where the bits are disposed on the links in a staggered orientation for cutting along differing cutting paths and wherein at least a substantial number substantially all of the bits are oriented within the above-described ranges of penetration and sideward angles.

DESCRIPTION OF THE PREFERRED EMBODIMENT

Figure 1:
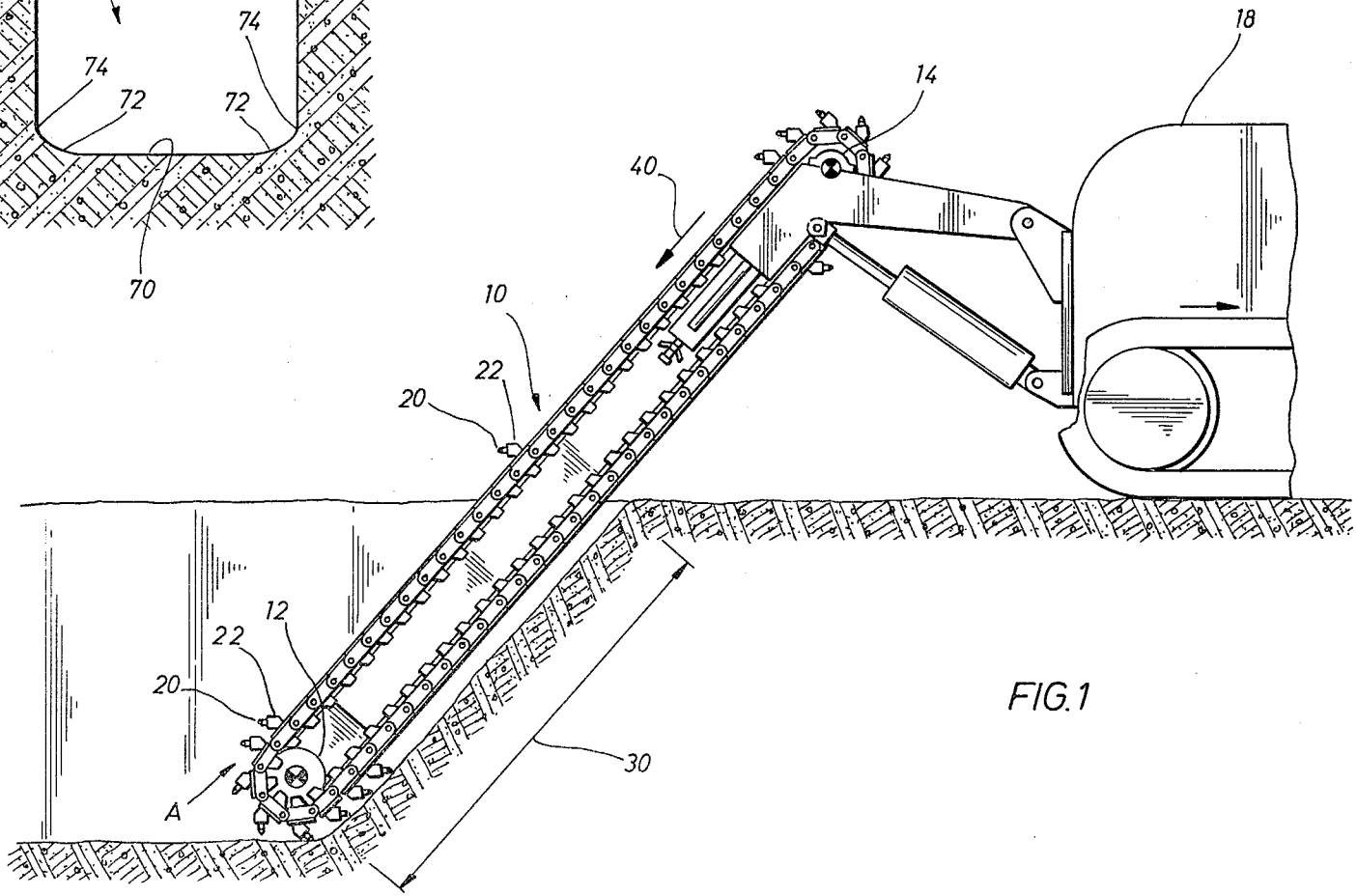
FIG. 1 is a side-view of a chain link conveyor assembly in an operative cutting position in an earth formation and illustrating the penetration angle of the bits. Most of the bits are not shown to facilitate illustration.
Figure 2:
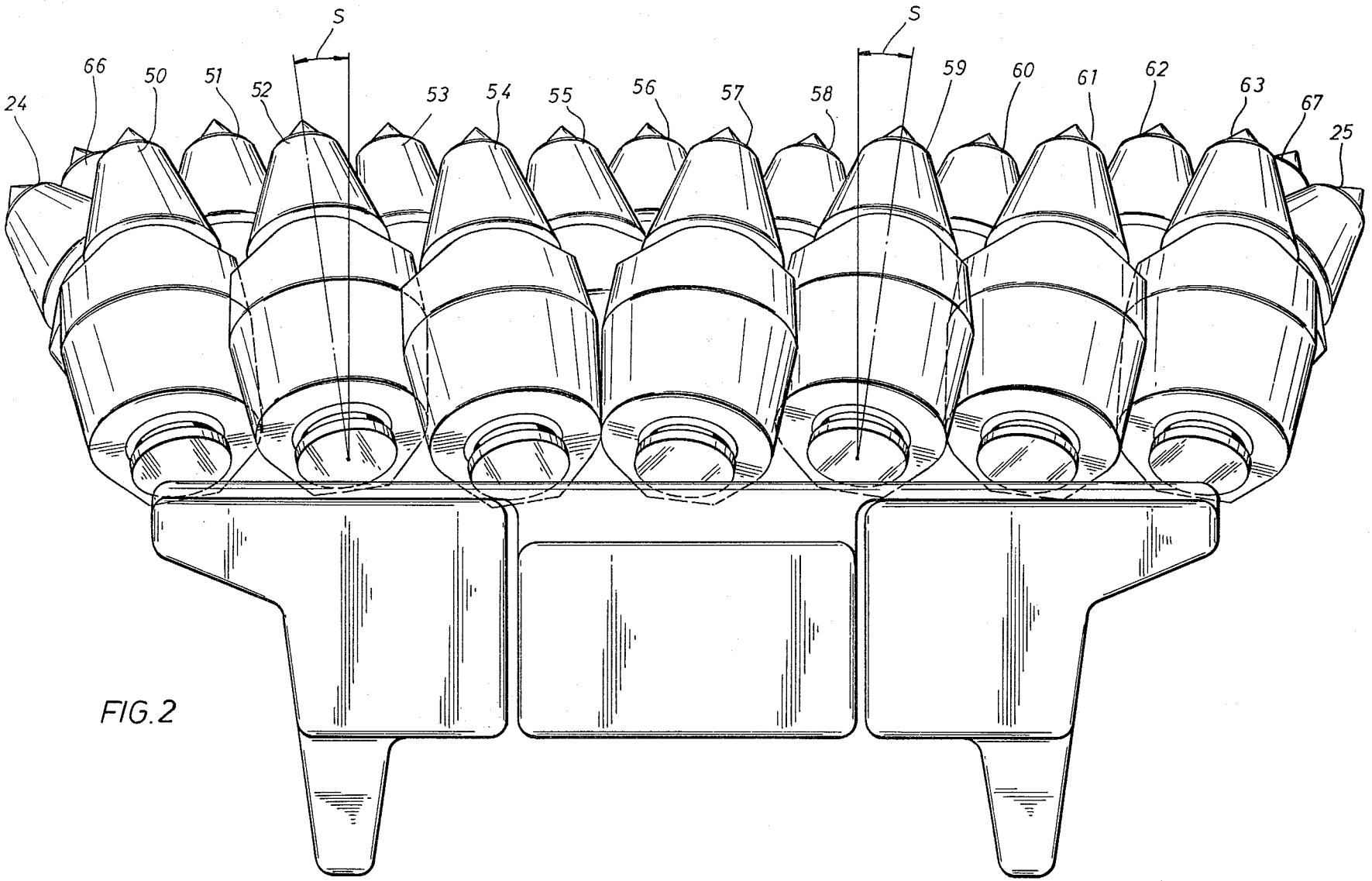
FIG. 2 is an illustration of the bits of one repetitive section of the conveyor assembly as viewed along the arrow A of FIG. 1 and illustrating the staggered orientation and sideward angle of the bits.

Referring to the drawings, and particularly to FIGS. 1 and 2, there is illustrated a chain link conveyor assembly 10 of the type which is articulated from a prime mover 18 (only a portion shown) at a selected angle for effecting earth cutting. Assembly 10 is of the general type disclosed in U.S. Pat. No. 3,954,301, which is incorporated herein by reference. The structure and operation of an earth cutting machine utilizing a chain link conveyor assembly for cutting hard earth formations is set forth in detail in U.S. Pat. No. 3,954,301 and will not be described in detail herein.

Assembly 10 is adapted for moving on a pair of rotary conveyor sprockets 12, 14 which continuously drive the interconnected links comprising the chain link conveyor. Assembly 10 is articulated at a selected angle from a prime mover 18 at an angle of between 0° and 90° from the earth's surface. (The greater the angle, the deeper the cut.) A plurality of conical cutting bits 20 are secured to the links 21 by bit blocks 22 which comprise the bit retainer means and which allow the bits to rotate about their longitudinal axes. The tip of each bit includes a tungsten carbide insert 28. As best shown in FIG. 2, the bits are disposed along repetitive lengths of the conveyor in a staggered orientation so that the respective bits may cut along differing cutting paths. Preferably, at least one bit on each side is angled outwardly by approximately 45° to cut the gauge of the kerf, for example, bits 24 and 25 shown in FIG. 2. As pointed out above, the present invention primarily relates to the orientation of the bits in order to reduce the wear rate and to promote even wear.

Figure 3:
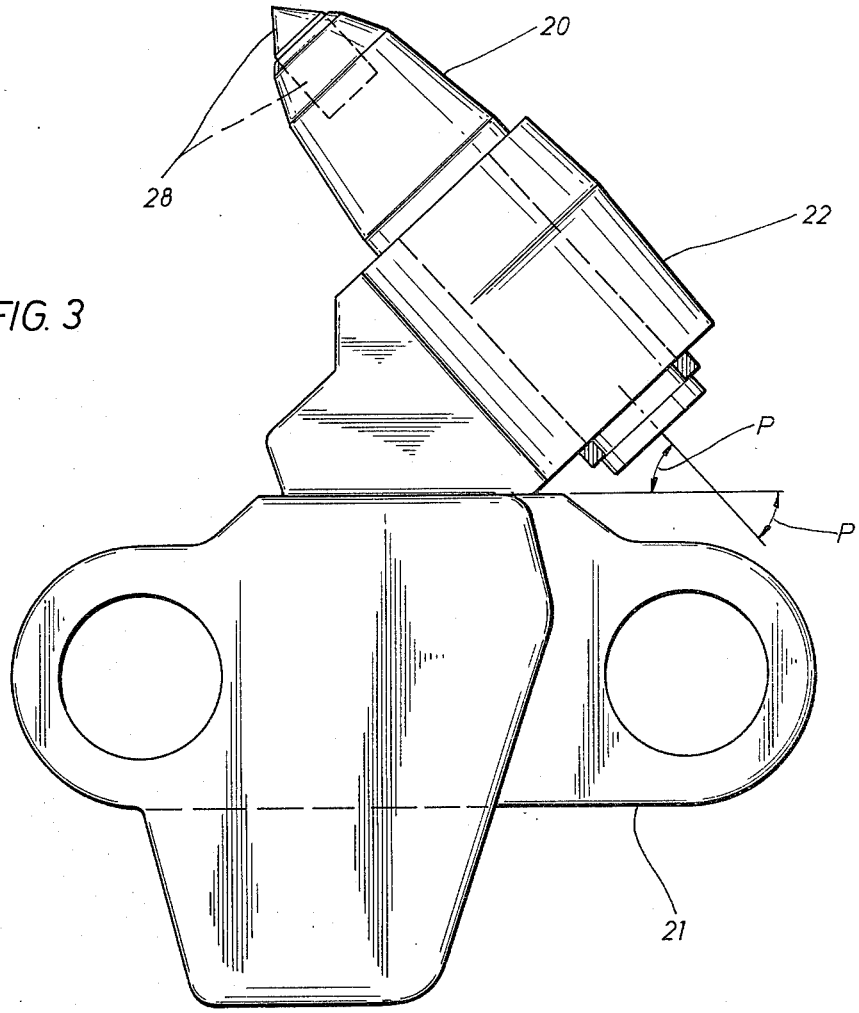
FIG. 3 is a side view of a typical bit and its associated bit block and mount.
Figure 4:
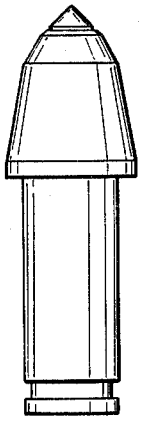
FIG. 4 is a view of a typical conical cutting bit.
Figure 5:
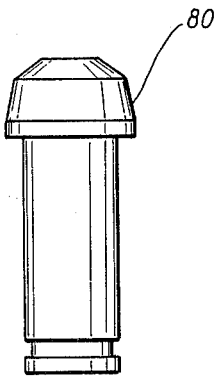
FIG. 5 is a view of a worn bit resulting from a penetration angle that is too great.

As best shown in FIG. 3, the penetration angle "P" of the bits is the angle formed between the longitudinal axes of the bits and the conveyor chain. This angle determines the attitude at which the bits attack the earth formation along the cutting line designated by the line segment 30 in FIG. 1. A discovery forming a basis for the present invention is the discovery that penetration angles which are too great cause the tip of the bit to strike the earth formation directly, thereby resulting in a rapid blunting of the nose of the bit as illustrated by bit 80 in FIG. 5. It has also been discovered that penetration angles that are too small result in the bit sliding or bouncing off of the earth formation and not effectively cutting. By experimentation it has been found that the ideal range for the penetration angle, when used in conjunction with a sideward bit angle as described below, is in the range from 47° to 53°, with 50° being the preferred penetration angle.

Figure 6:
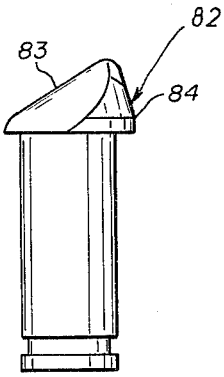
FIG. 6 is a view of a worn bit resulting from the bit not rotating during the earth cutting operation.

It also has been discovered that a primary reason for the rapid wear of bits mounted on cutter chains in the conventional "straight-ahead" fashion is that the same portion of each bit repetitively strikes the earth formation. Uneven bit wear as illustrated by bit 82 in FIG. 6 typically results wherein the portion 83 of the bit repetitively stikes the earth so that that portion wears rapidly and becomes lighter than the opposite side 84. To explain why portion 83 wears rapidly, it first must be appreciated that during the travel of the bit along the non-cutting portion 40 of the cutter bar, the bit rotates about its longitudinal axis so as to put the heavier portion 84 at the bottom and the lighter, worn portion 83 at the top. This rotation to a dynamically stable position is encourage by the vibration of the apparatus. Thus, when the chain makes its turn at sprocket 12, the worn, lighter portion 83 is always in a position to strike the earth and wear even more. Thus, it can be seen that as the bit progressively wears at 83, the tendency for that portion to repetitively strike the earth increases.

Figure 8:
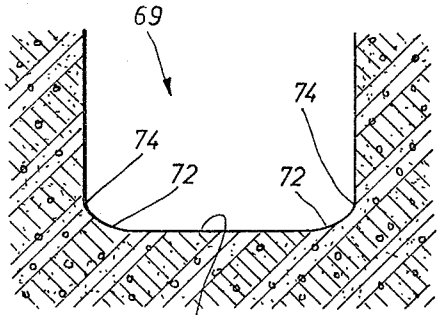
FIG. 8 is a section view of a ditch or kerf cut by the apparatus of the present invention.

To deal with this problem, in accordance with the present invention, all or at least a substantial number substantially all of the inner cutting bits (i.e., the bits not cutting the gauge of the kerf) are leaned outwardly to a sideward angle "S" in the range of 3° to 12°, with 7½° being the preferred sideward angle. As shown in FIG. 2, all of the inner cutting bits numbered 50–63 are oriented with a sideward angle "S" of 7½°. Bit 56 is the center bit which is arbitrarily slanted to the left as viewed in FIG. 2. As mentioned above, the extreme outer bits 24, 25 which cut the gauge of the kerf are slanted outwardly at 45° in order to cut the kerf. The second-from-the-outside bits 66, 67, which also cut the gauge of the kerf, are slanted at an angle of 30° to encourage a gradual rounding of the ditch or kerf. As shown in FIG. 8, the ditch or kerf 69 includes a flat bottom wall 70, a curved portion 72 and a kerf gauge portion 74. Curved portion 72 is cut primarily by bits 66, 67 while kerf gauge portion 74 is cut primarily by bits 24, 25.

It has been found that the sideward orientation of the bits produces a rotation of the bits as they strike the earth formation and results in a more random and even wear pattern without reducing the cutting efficiency of the bits. A sideward angle less than 3° does not encourage adequate rotation while a sideward angle in excess of 12° reduces cutting efficiency. Therefore, a working range for sideward angle "S" is 3° to 12°, with 7½° being preferred.

Figure 7:
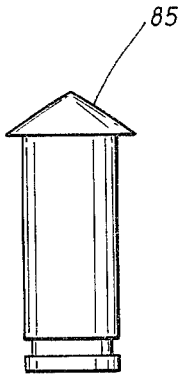
FIG. 7 is a view of an evenly worn bit after use in accordance with the present invention.

While improved bit wear may be achieved by utilizing only the described penetration angle without the sideward angle, or vice versa, it has been found that a combination of the described penetration and sideward angles results in (1) a remarkable increase in bit life and (2) even bit wear before unachieved in the art. Even bit wear patterns as illustrated by bit 85 in FIG. 7 may be achieved by practicing the present invention.

The instant invention has been described in connection with specific embodiments. However, it will be apparent to those skilled in the art that variations from the illustrated embodiment may be undertaken without departing from the spirit and scope of the invention.

What is claimed is:

1. In an apparatus for cutting hard earth formations of the type having a continuous chain link conveyor assembly comprising a plurality of interconnected links carrying bits for effecting cutting wherein a portion of the bits are inner bits for cutting the central portion of the kerf and the remaining bits are outer bits for cutting the gauge of the kerf, an improvement in said chain link conveyor assembly comprising securing substantially all of the inner bits at a suitable penetration angle and a sideward angle in the range from 3° to 12°.

2. An apparatus as claimed in claim 1 wherein said penetration angle is in the range of 47° to 53°.

3. An apparatus as claimed in claim 1 wherein said sideward angle is approximately 7½°.

4. An apparatus as claimed in claim 1 wherein said penetration angle is approximately 50° and said sideward angle is approximately 7½°.

5. A chain link conveyor assembly adapted for mounting on the rotary conveyor sprockets of an earth cutting machine, comprising:

a plurality of interconnected links adapted for mating engaging relation with the rotary conveyor sprockets;

a plurality of conical bits mounted by appropriate retainer means for rotation about their longitudinal axes, said bits being disposed on said links in a staggered orientation for cutting along differing cutting paths;

the bits including inner bits for cutting the central portion of the kerf and outer bits for cutting the gauge of the kerf; and substantially all of the inner bits being mounted by their respective retainer means at a suitable penetration angle and a sideward angle in the range from 3° to 12°.

6. A chain link conveyor assembly as claimed in claim 5 wherein said penetration angle is in the range of 47° to 53°.

7. A chain link conveyor assembly as claimed in claim 5 wherein said sideward angle is approximately 7½°.

8. A chain link conveyor assembly as claimed in claim 5 wherein said penetration angle is approximately 50° and said sideward angle is approximately 7½°.

9. A chain link conveyor assembly as claimed in claim 5 wherein at least one outer bit on each side of the assembly is positioned at a sideward angle greater than 12° for cutting the gauge of the kerf.

* * * * *

UNITED STATES PATENT AND TRADEMARK OFFICE

CERTIFICATE OF CORRECTION

PATENT NO. : 4,244,625

DATED : January 13, 1981

INVENTOR(S) : Gilbert M. Turner et al

It is certified that error appears in the above-identified patent and that said Letters Patent are hereby corrected as shown below:

In The Specification

Col. 1, line 52 - after "conical", insert -- cutting --.

Col. 1, lines 59 and 60 - delete "at least a substantial number".

Col. 2, lines 2 and 3 - delete "at least a substantial number".

Col. 3, line 34 - delete "at least a substantial number".

Signed and Sealed this

*Twenty-eighth* Day of *April 1981*

[SEAL]

*Attest:*

RENE D. TEGTMEYER

*Attesting Officer*

*Acting Commissioner of Patents and Trademarks*